US006598265B2

(12) United States Patent
Lee

(10) Patent No.: US 6,598,265 B2
(45) Date of Patent: Jul. 29, 2003

(54) HANDLE STRUCTURE OF AN APPARATUS FOR OPENING AND CLOSING A WINDOW

(75) Inventor: Jang-Woo Lee, Seoul (KR)

(73) Assignee: 3 G Technology (KR)

( * ) Notice: Subject to any disclaimer, the term of this patent is extended or adjusted under 35 U.S.C. 154(b) by 0 days.

(21) Appl. No.: 09/950,164

(22) Filed: Sep. 10, 2001

(65) Prior Publication Data

US 2002/0029437 A1 Mar. 14, 2002

(30) Foreign Application Priority Data

Sep. 9, 2000 (KR) ..... 2000-0053659

(51) Int. Cl.[7] ..... B25G 1/04; A45C 13/22

(52) U.S. Cl. ..... 16/429; 16/110.1

(58) Field of Search ..... 16/429, 110.1; 74/526, 527, 528, 543, 548; 49/324, 329; 403/362, 359.5, 378

(56) References Cited

U.S. PATENT DOCUMENTS

| | | | | |
|---|---|---|---|---|
| 3,007,348 A | * | 11/1961 | Barnes | 16/110.1 |
| 4,162,805 A | * | 7/1979 | Hirschberger | 296/223 |
| 4,390,203 A | * | 6/1983 | Lutz et al. | 296/214 |
| 5,400,473 A | * | 3/1995 | Delman | 16/429 |
| 5,467,503 A | * | 11/1995 | Nolte et al. | 16/429 |
| 5,551,316 A | * | 9/1996 | Blank | 16/429 |
| 5,560,082 A | * | 10/1996 | Vetter | 16/429 |
| 5,802,673 A | * | 9/1998 | Nemeth | 16/429 |

FOREIGN PATENT DOCUMENTS

| | | | |
|---|---|---|---|
| GB | 2281756 A | * | 3/1995 |
| JP | 10280797 A | * | 10/1998 |
| KR | 2001068601 A | * | 7/2001 |

* cited by examiner

*Primary Examiner*—Chuck Y. Mah
(74) *Attorney, Agent, or Firm*—McKee, Voorhees & Sease, P.L.C.

(57) ABSTRACT

Disclosed is a handle structure of an apparatus for opening and closing a window capable of allowing a user to open and close the window with safety. The handle structure may be mounted to a driving shaft installed in a housing of the apparatus for opening and closing the window and may then be foldable. In the handle structure, a depressed portion is formed on an inner surface of a body portion of the handle structure and extends along the longitudinal direction. Pair of fixed members is formed on the inner surface of the body portion within the depressed portion and extend over a predetermined length of the depressed portion. A supporting device is suitably secured together with the fixed members formed in the depressed portion. The supporting device is provided with a rectangular plate-shaped supporting piece, a hexahedral-shaped moving member and a coiled spring. A knob is engaged to be one body with an outer surface of one end portion of the body portion. A bore is formed at an inner side of the other end portion of the body portion. A joining member having an inserting portion and a locking portion is mounted in the bore. The body portion may be pivoted with centering on a joining pin for fixing the joining member to the body portion. When the handle structure is not to be use, it can be folded. This handle structure can be maintained with safety whether it is to be use or not.

4 Claims, 5 Drawing Sheets

HANDLE STRUCTURE OF AN APPARATUS FOR OPENING AND CLOSING A WINDOW

PRIORITY CLAIM

This application claims priority to Korean Patent Application No. 10-2000-0053659 filed on Sep. 9, 2000.

BACKGROUND OF THE INVENTION

1. Field of the Invention

The present invention relates to a handle structure of an apparatus for opening and closing a window, and more particularly to a handle structure of an apparatus for opening and closing a window capable of allowing a user to open and close the window with safety, which is capable of being maintained with safety whether it is to be use or not, in which the handle structure may be mounted to a driving shaft installed in a housing of the apparatus for opening and closing the window and may then be foldable.

2. Description of the Related Art

Generally, apparatuses for opening and closing a window may be classified to an automatic apparatus for opening and closing a window with a motor, and a hand-operated apparatus for opening and closing a window. More particularly, the hand-operated apparatus may be installed to a window frame and may then be controlled by the hand of a user.

FIG. 4 shows a handle structure of the hand-operated apparatus for opening and closing a window according to a prior art.

As shown in FIG. 4, the handle structure 10 is provided with a rounded body part 12, a knob 14 mounted to an outer surface of the body part 12 at a one end thereof, and a joining portion 16 mounted to the other end of the body part 12.

The knob 14 is designed with ergonomic consideration and is engaged to be one body with the outer surface of the body part 12. A shaft-inserting groove 18 is formed in the joining portion 16. A driving shaft (X) installed in a housing (H) of an apparatus for opening and closing a window is inserted into the shaft-inserting groove 18.

When it is desired to open or close a window by using the handle structure 10 as described above, a user must the driving shaft (X) of the housing (H) for the apparatus for opening and closing the window to be inserted into the shaft-inserting groove 18 of the joining portion 16. Thereby, the handle structure 10 may be fixed to the housing (H).

Under this state, if the user rotates the handle structure 10 in the clockwise direction or the counterclockwise direction by using the knob 14 mounted to the one end of the body portion 12, and thereafter the driving shaft (X) is rotated. And then, the window may be opened or closed.

However, the handle structure according to the prior art cannot be folded. Accordingly, it takes up much space at a position adjacent to the window frame. Since the handle structure protrudes to the outside from the window frame, the user's hand may be injured during the use of his/her hand to manually operate the handle. Further, the window frame looks bad externally.

In order to solve the above problems, a variety of endeavors for developing a foldable handle structure of an apparatus for opening and closing a window have been proposed. However, other conventional handle structures do not have a function for fixing the handle structure whether the handle structure is to be use or not. Consequently, it is impossible to open or close the window with safety.

SUMMARY OF THE INVENTION

The present invention solves the foregoing problems. It is an object of the present invention to provide a handle structure of an apparatus for opening and closing a window capable of allowing a user to open and close the window with safety, which is capable of being maintained with safety whether it is to be use or not.

It is another object of the present invention to provide a handle structure of an apparatus for opening and closing a window which can help prevent the user's hand from being injured during the use of his/her hand to manually operate the handle structure in order to open and close the window.

It is another object of the present invention to provide a handle structure of an apparatus for opening and closing a window capable of giving a good appearance to the window.

In order to achieve the above objects, the present invention provides a handle structure of an apparatus for opening and closing a window, the handle structure comprising:

- a body part including a vertical portion, a horizontal portion, a depressed portion being fromed on an inner surface of the body part at a position adjacent to the vertical portion and extending along the longitudinal axis of the vertical portion, a pair of fixed members being formed on the inner surface of the body part within the depressed portion and extending over a predetermined length of the depressed portion;
- a knob being engaged to be one body with an outer surface of the vertical portion; and
- a joining member having an inserting portion and a locking portion which are integrally formed with each other, the joining member being engaged to be one body in the horizontal portion of the body part.

A supporting device is suitably secured together with the fixed members formed in the depressed portion. The supporting device is provided with a rectangular plate-shaped supporting piece, a hexahedral-shaped moving member and a coiled spring.

An inserting groove for receiving a driving shaft in a housing of an apparatus for opening and closing a window is formed at the center of the locking portion and the inserting portion. The joining member is assembled with the body part by means of a joining pin passing through the pin inserting hole and the pin through hole when the inserting portion has been disposed in the bore of the body part. Under the state that the joining member is mounted to the driving shaft installed in the housing of the apparatus for opening and closing the window, the body part can be pivoted to the joining member in the clockwise direction or the counterclockwise direction.

As described above, in the handle structure of the apparatus for opening and closing the window according to the present invention, the handle body can be maintained in a folded state against the driving shaft installed in the housing of the apparatus for opening and closing the window.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the handle structure of an apparatus for opening and closing a window according to the preferred embodiment of the present invention will be explained in more detail with reference to the accompanying drawings.

Figure 1:
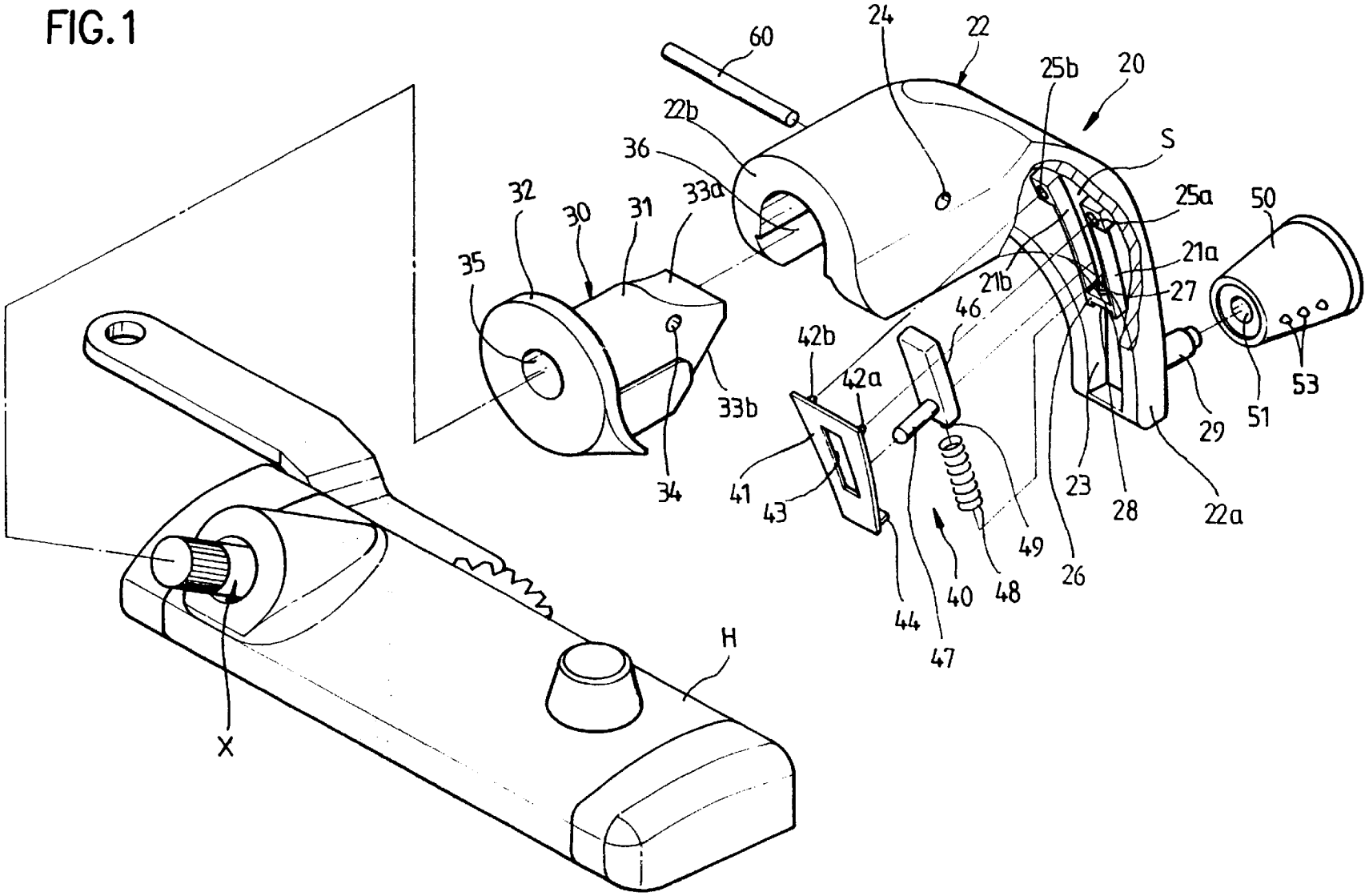
FIG. 1 is an exploded perspective view of a handle structure of an apparatus for opening and closing a window according to a preferred embodiment of the present invention.
Figure 2:
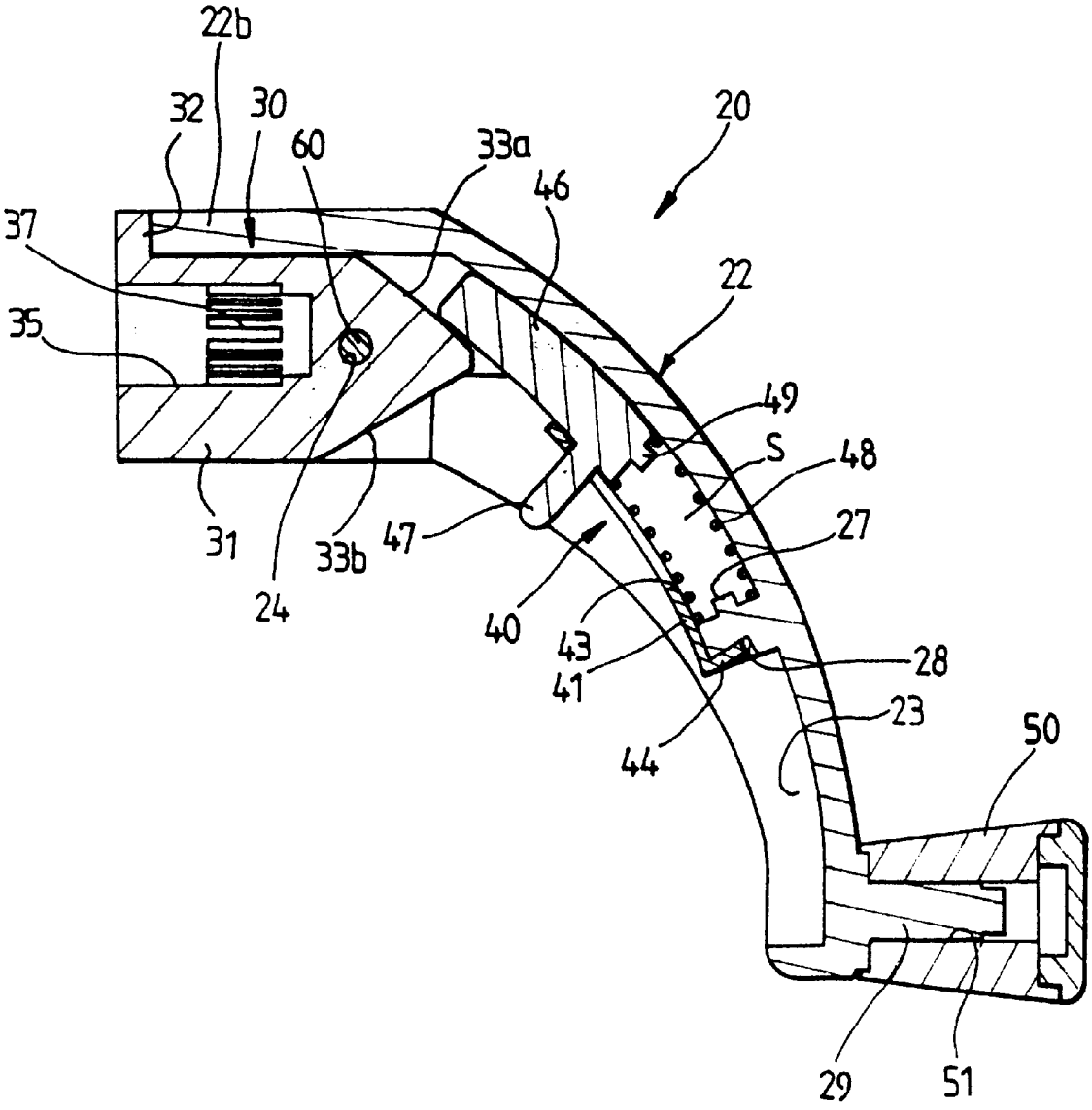
FIG. 2 is a longitudinal sectional view illustrating installation and operation of the handle structure according to the preferred embodiment of the present invention.

As shown in FIGS. 1 and 2, the handle structure 20 according to the present invention includes a rounded body part 22, a knob 50 which is engaged to be one body with an outer surface of a vertical portion 22*a* of the body part 22, and a joining member 30 which is engaged to be one body in a horizontal portion 22*b* of the body part 22.

The body part 22 is rounded as a "¬" shape and thereby the longitudinal axis of the vertical portion 22*a* of the body part 22 is substantially perpendicular to the longitudinal axis of the horizontal portion 22*b* of the body part 22. A depressed portion 23 is formed on an inner surface of the body part 22 at a position adjacent to the vertical portion 22*a* and extends along the longitudinal axis of the vertical portion 22*a* of the body part 22.

A pair of fixed members 21*a*,21*b* are formed on the inner surface of the body part 22 within the depressed portion 23 and extend over a predetermined length of the depressed portion 23. A space (S) is provided between the fixed members 21*a*,21*b*, and fixing grooves 25*a*,25*b* are formed at upper ends of the fixed members 21*a*,21*b*. A connecting stage 26 horizontally extends between lower ends of the fixed members 21*a*,21*b*. At this time, a first protrusion 27 is formed projecting upwardly integrally with an upper surface of the connecting stage 26. A locking stage 28 is formed at a lower portion of the connecting stage 26.

A supporting device 40 is suitably secured together with the fixed members 21*a*,21*b* formed in the depressed portion 23. The supporting device 40 is provided with a rectangular plate-shaped supporting piece 41, a hexahedral-shaped moving member 46 and a coiled spring 48. An elongated guide hole 43 is formed through the center of the supporting piece 41. Joining protrusions 42*a*,42*b* are formed projecting horizontally integrally with a rear upper end of the supporting piece 41. Also, a joining stage 44 is formed projecting horizontally integrally with a rear lower end of the supporting piece 41. At this time, the joining stage 44 protrudes in the same projecting direction as of the joining protrusions away from the rear lower end of the supporting piece 41.

The moving member 46 has a lever 47, which is formed projecting horizontally integrally with a front lower end of the moving member 46. A second protrusion 49 is formed projecting downwardly integrally with a bottom surface of the moving member 46.

When the supporting piece 41 and the moving member 46 has been mounted to the body part 22 of the handle structure 20, the moving member 46 is disposed in the space(s), which is provided between the fixed members 21*a*,21*b* and the connecting stage 26, within the depressed portion 23 of the body part 22. At this time, the supporting piece 41 covers the front surface of the moving member 46. Furthermore, the joining protrusions 42*a*,42*b* formed at the rear upper end of the supporting piece 41 are inserted into the fixing grooves 25*a*,25*b* of the fixed members 21*a*,21*b*. The joining stage 44 projecting from the rear lower end of the supporting piece 41 is fitted into the locking stage 28 which is formed at the lower portion of the connecting stage 26 of the body part 22. At this time, the lever 47 of the moving member 46 is inserted into the guide hole 43 of the supporting piece 41 and thereafter it is exposed to the outside of the supporting piece 41. Also, the coiled spring 48 for elastically supporting the moving member 46 is vertically disposed between the first protrusion 27 of the body part 22 and the second protrusion 49 of the moving member 35. The coiled spring 48 is enclosed by the supporting piece 41.

In the meantime, a knob fixing protrusion 29 is formed projecting horizontally integrally with an outer surface of the body part 22 at a position adjacent to the vertical portion 22*a*. The knob fixing protrusion 29 is opposite to the depressed portion 23 of the body part 22 and protrudes in the direction, which is substantially perpendicular to the body part 22.

The knob 50 is mounted to the knob fixing protrusion 29 formed on the outer surface of the body part 22. For this purpose, a fitting groove 51 is formed in a one side of the knob 50, which is correspond to the knob fixing protrusion 29. The knob 50 is mounted to the outer surface of the body part by inserting the knob fixing protrusion 29 into the fitting groove 51. Pluralities of protrusions 53 are formed at a radial outer surface of the knob 50 so that a user may easily grip the knob 50.

Meanwhile, a pin inserting hole 24 is horizontally formed through the body part 22 at a position adjacent to the horizontal portion 22*b* of the body part 22. Also, a bore 36 for receiving the joining member 30 is formed at an inner side of the horizontal portion 22*b* of the body part 22. The joining member 30 is provided with an inserting portion 31 and a locking portion 32 which are integrally formed with each other.

The inserting portion 31 extends from a one side of the locking portion 32 in a direction, which is perpendicular to the locking portion 32. The inserting portion 31 has a shape corresponding to the shape of bore 36. A shaft-inserting groove 35 is formed at the center portion of the locking portion 32 and the inserting portion 31. The shaft-inserting groove 35 extends over the full width of the locking portion 32 and a predetermined length of the inserting portion 31. The driving shaft (X) installed in the housing (H) of an apparatus for opening and closing a window (not shown) is inserted into the shaft-inserting groove 35. For this purpose, a female thread 37 is formed at a radial inner surface of the shaft-inserting groove 35. The female thread 37 is corresponding to a male thread (not shown) which is formed at a radial outer surface of the driving shaft (X) in the housing (H).

A pair of fitting surfaces 33*a*,33*b* are formed at a free end of the inserting portion 31 which is opposite to the locking portion 32 of the joining member 30. A pin through hole 34 is formed through the inserting portion 31 at a position adjacent to the fitting surfaces 33*a*,33*b*. When the inserting portion 31 of the joining member 30 has been disposed in the bore 36 formed in the portion 22*b* of the body part 22, the joining member 30 is assembled with the body part 22 by means of a joining pin 60 passing through the pin inserting hole 24 and the pin through hole 34 formed at the inserting portion 31.

Hereinafter, the operation of the handle structure of an apparatus for opening and closing a window according to the embodiment the present invention as above will be described in detail with reference drawings FIGS. 2 and 3B.

At first, as shown in FIG. 2, when the inserting portion 31 of the joining member 30 has been inserted into the bore 36 formed in the horizontal portion 22*b* of the body part 22 in the handle structure 20, the joining pin 60 is inserted into the pin inserting hole 24 formed at the horizontal portion 22*b* and the pin through hole 34 formed at the joining member 30. Thereby, the joining member 30 is assembled with the body part 22 of the handle structure 20. Under this state, the driving shaft(X) of the housing(H) for the apparatus for opening and closing the window is inserted into the shaft-inserting groove 35 of the joining member 30 so that the handle structure(20) is mounted to the housing(H) of the apparatus for opening and closing the window.

When a user wants to operate the apparatus for opening and closing the window in a state that the handle structure (20) has been mounted to the housing(H) of the apparatus for opening and closing the window, he or she rotates the handle structure 20 in the clockwise direction or the counterclockwise direction by using the knob 50 mounted to the lower end of the body part 22 of the handle structure 20. Then, the driving shaft(X) of the housing(H) begins to be rotated and thereby the window(not shown) may be opened or closed. If the window is moved to a fully open position or a fully closed position for the window, the user stops operating the handle structure 20.

Under the state that the window is fully opened or closed, the front surface of the moving member 46 disposed in the depressed portion 23 of the handle structure 20 is brought into tightly contact with the fitting surface 33*a*, which is formed at the one side of the inserting portion 31 of the joining member 30, with the aid of an elastic force of the coiled spring 48. As a result, it is possible to prevent the handle structure from being shaken. Consequently, the handle structure for opening and closing the window may be "locked" in either a fully closed or fully open position and thereafter it is maintained in a stable state.

Figure 3A:
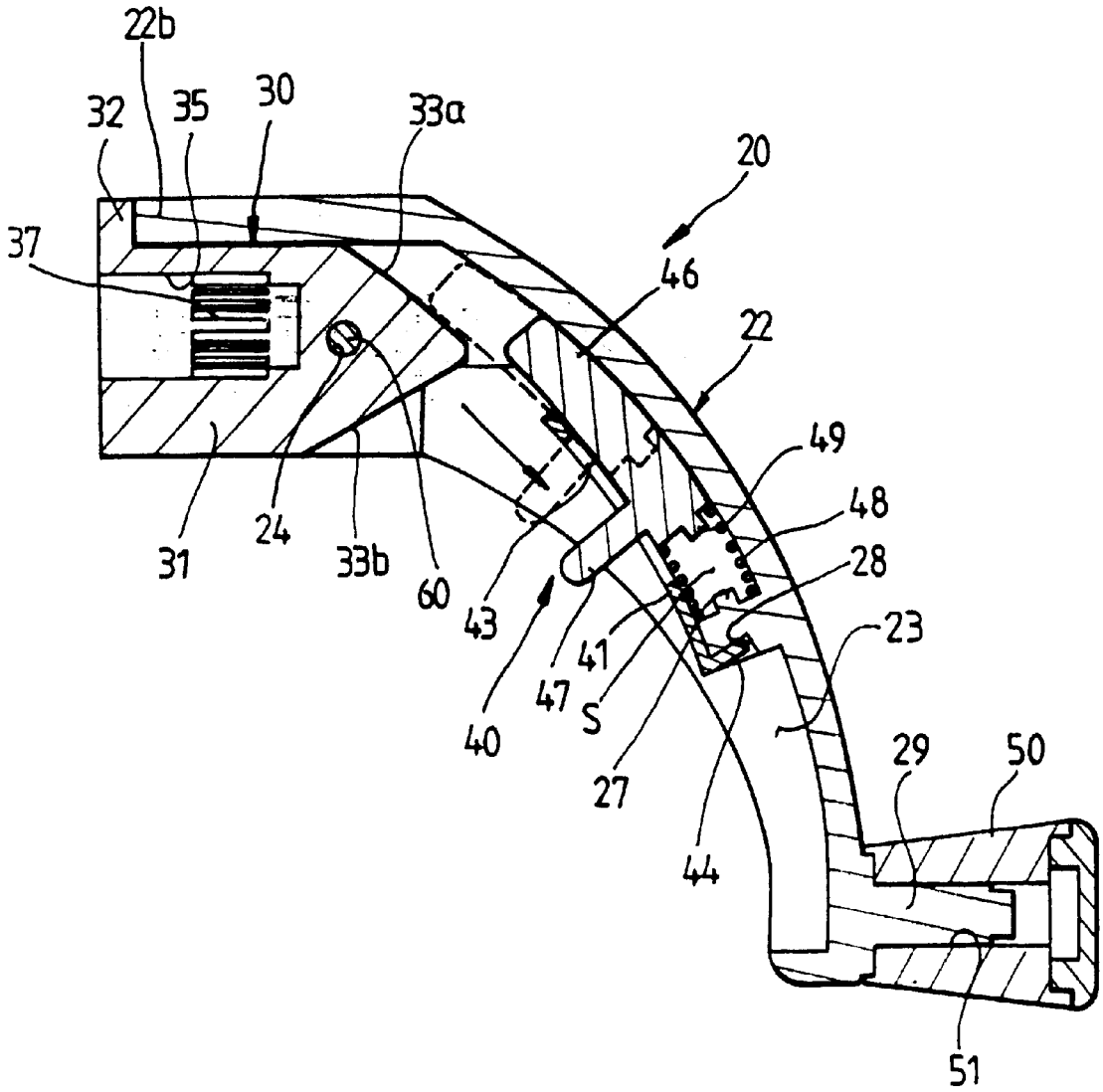
FIGS. 3A and 3B are longitudinal sectional view showing the operation of the handle structure according to the preferred embodiment of the present invention.
Figure 3B:
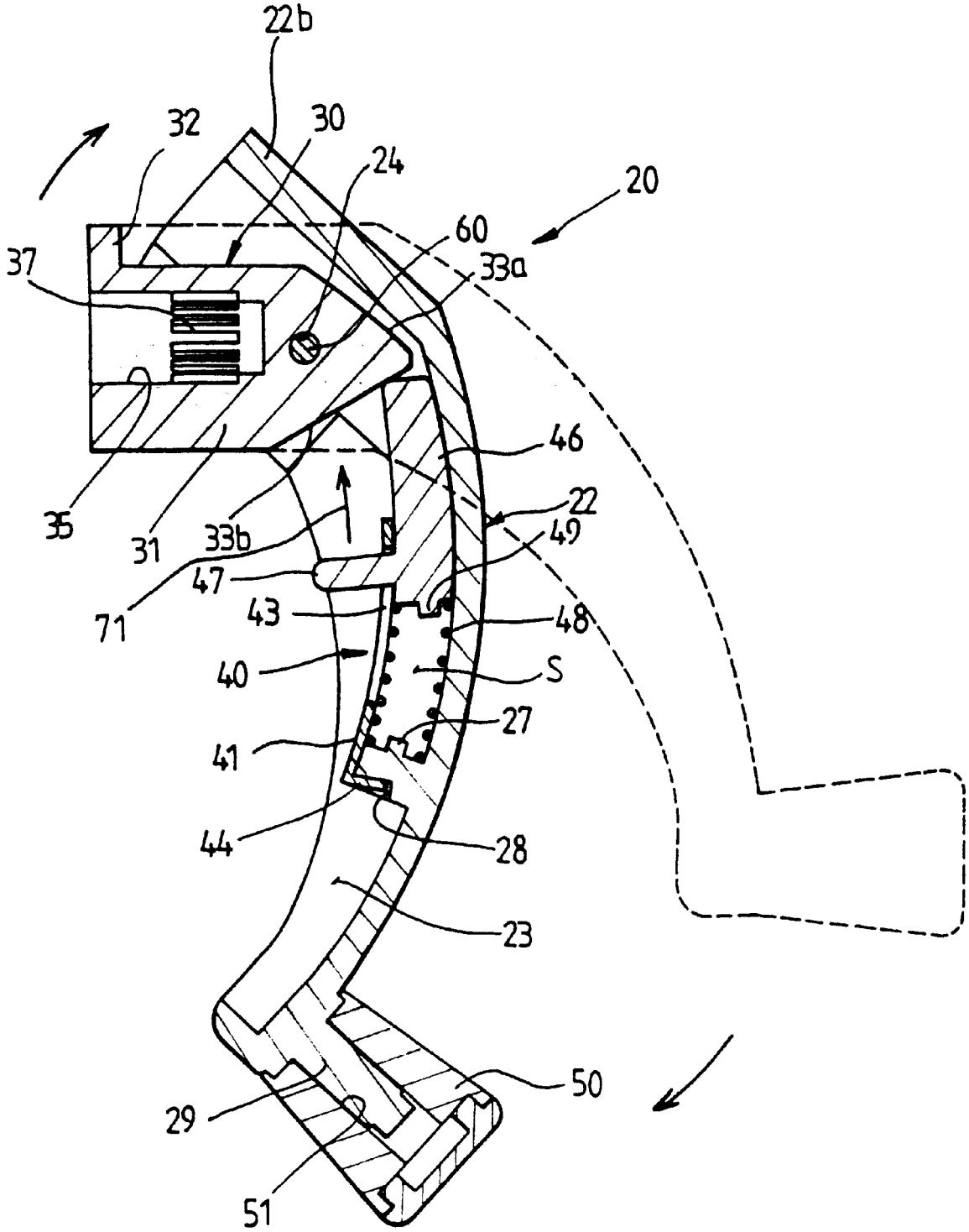
Figure 4:
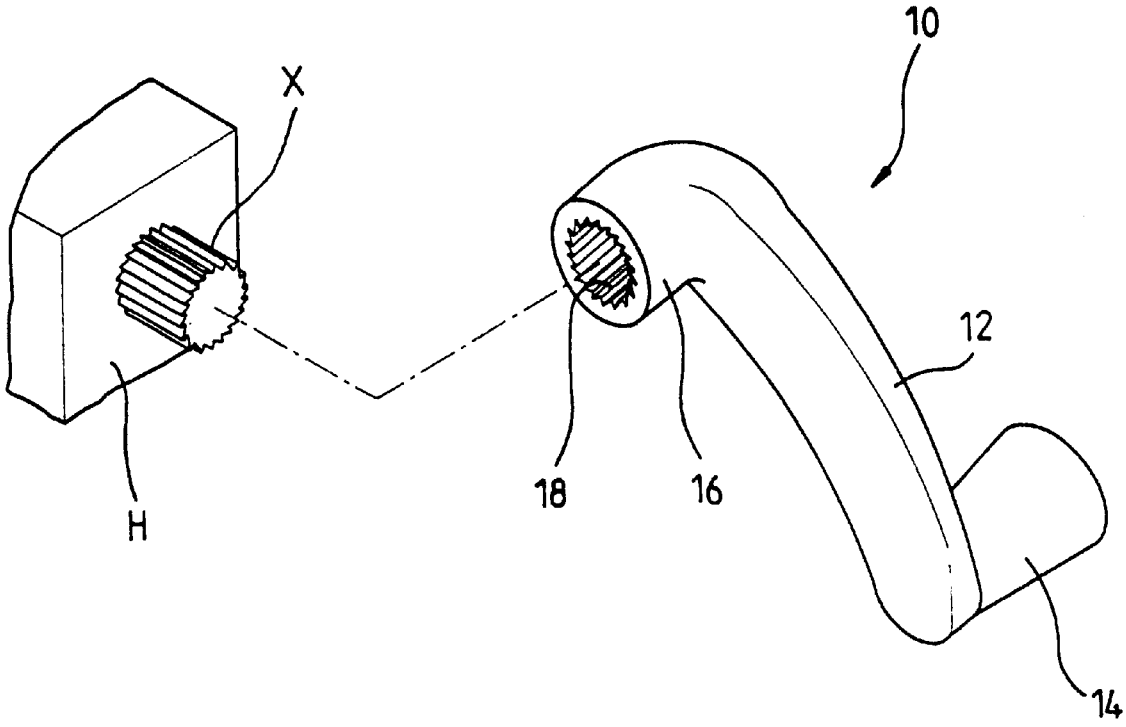
FIG.4 (PRIOR ART)
FIG. 4 is an exploded perspective view of a handle structure of an apparatus for opening and closing a window according to a prior art.

When it is desired to not operate the handle structure 20, the handle structure 20 may be maintained as a folded state after going through the operating process as shown in FIGS. 3A and 3B. At first, as may be best seen in FIG. 3A, the lever 47 of the moving member 46 is pulled as shown in the arrow direction. Then, the lever 47 moves downward along the guide hole 43 of the supporting piece 41. At this time, the moving member 46 moves downward along the space (S), which is, provided between the fixed members 21*a*,21*b*. As a result, the front surface of the moving member 46 is released from the fitting surface 33*a* of the joining member 30. At the same time, the coiled spring 48 disposed between the second protrusion 49 of the moving member 46 and the first protrusion 27 of the body part 22 within the depressed portion 23 is compressed at a predetermined distance corresponding to the movement of the moving member 46.

Then, the handle structure 20 is rotated in the clockwise direction as shown in FIG. 3B, so that the body part 22 of the handle structure 20 is pivoted in the clockwise direction with centering around the joining pin 60. At the same time, the locking portion 32 of the joining member 30 is released from the radial inner side surface of the bore 36. Thereafter, fi the user release the lever 47 of the moving member 46, the coiled spring 48 returns an initial state. After a second period of time the moving member 46 returns to normal operation with moving along the arrow direction 71. As a result, the front surface of the moving member 46 is brought into tightly contact with the fitting surface 33*b* of the joining member 30. Consequently, the handle structure 20 for opening and closing the window may be folded in either a fully/partially closed or fully/partially open position and thereafter it is maintained in a stable state.

When it is desired to operate the handle structure 20 folded as described above, the moving member 46 may be moved downwards as shown by the arrow and the moving member 46 may then be released. Thereafter, the user makes the handle structure 20 to be rotated in the counterclockwise direction. When the handle structure 20 is pivoted in the counterclockwise direction with centering around the joining pin 60, and then the horizontal 22*b* is brought into tightly contact with the fitting surface 33*b* of the joining member 30. Thereafter, if the user releases the lever 47 of the moving member 46, the coiled spring 48 returns an initial state. After a second period of time the moving member 46 returns to normal operation. Accordingly, the front side surface of the moving member 46 is brought into tightly contact with the fitting surface 33*b* of the joining member 30. Consequently, the handle structure 20 returns to its normal operation and is maintained in a stable state.

When the handle structure 20 returns to its normal operating state as shown in FIG. 2 with going through the process as described above, the user may operate the apparatus for opening and closing the window by rotating the handle structure 20 in the clockwise direction or the counterclockwise direction.

As described above, in the handle structure of the apparatus for opening and closing the window according to the present invention, the handle body can be maintained in a folded state when the handle structure is out of use. Since the handle structure is elastically supported by the coiled spring, it is possible to prevent the handle structure from being shaken. Consequently, the opening and closing the window may be performed with safety. Since the handle structure may be folded in case of need, it can give a good appearance to the window.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. A handle structure of an apparatus for opening and closing a window, the handle structure comprising:

a body part including a vertical portion, an horizontal portion, a depressed portion being formed on an inner surface of the body part and longitudinally extending along the vertical portion, a pair of fixed members being axially mounted on the bottom of the depressed portion and extending over a predetermined length of the depressed portion;

a knob being engaged to be one body with an outer surface of the vertical portion; and a joining member having an inserting portion and a locking portion which are integrally formed with each other, the joining member being engaged to be one body in the horizontal portion of the body part, a connecting stage horizontally extended between lower ends of the fixed members so that a predetermined space is provided between the fixed members and the connecting stage, the joining member being slidingly inserted into the space, fixing grooves being formed at upper ends of the fixed members, a first protrusion being formed projecting upwardly integrally with an upper surface of the connecting stage, and a locking stage being formed at a lower portion of the connecting stage, wherein a supporting device being suitably secured to the fixed members formed in the depressed portion.

2. The handle structure as claimed in claim 1, wherein the supporting device is provided with a rectangular plate-shaped supporting piece, a hexahedral-shaped moving member and a coiled spring, in which an elongated guide hole is formed through the center of the supporting piece, joining protrusions are formed projecting horizontally integrally with a rear upper end of the supporting piece, a joining stage is formed projecting horizontally integrally with a rear lower end of the supporting piece, the joining stage protruding in the same projecting direction as of the joining protrusions away from the rear lower end of the supporting piece, a lever is formed projecting horizontally integrally with a front lower end of the moving member, and a second protrusion is formed projecting downwardly integrally with a bottom surface of the moving member, the moving member is inserted into the space provided between the fixed members and the connecting stage when the supporting device has been assembled with the body part, the coiled spring is disposed between the first protrusion of the body part and the second protrusion of the moving member, the joining protrusions of the supporting piece are inserted into the fixing grooves of the fixed members, the joining stage of the supporting piece is fitted into the locking stage, the lever of the moving member is inserted through the guide hole and thereafter it is exposed to the outside of the supporting piece.

3. The handle structure as claimed in claim 1, wherein a knob fixing protrusion is formed projecting horizontally integrally with an outer surface of the body part at a position adjacent to the vertical portion, a fitting groove corresponding to the knob fixing protrusion is formed in a one side of the knob, and the knob is mounted to the outer surface of the body part by inserting the knob fixing protrusion into the fitting groove.

4. The handle structure as claimed in claim 1, wherein a pin inserting hole is horizontally formed through the body part at a position adjacent to the horizontal portion of the body part, and a bore for receiving the joining member is formed at an inner side of the horizontal portion, the inserting portion extends from a one side of the locking portion having a disk shape in the direction which is perpendicular to the locking portion, the inserting portion having a shape corresponding to the shape of the bore, an inserting groove for receiving a driving shaft in a housing of an apparatus for opening and closing a window is formed at the center of the locking portion and the inserting portion, the inserting groove extending over the full width of the locking portion and a predetermined length of the inserting portion, a pair of slanted fitting surfaces are formed at a free end of the inserting portion which is opposite to the locking portion, a pin through hole is formed through the inserting portion at a position adjacent to the fitting surfaces, and the joining member is assembled with the body part by means of a joining pin passing through the pin inserting hole and the pin through hole when the inserting portion has been disposed in the bore of the body part.

* * * * *